US011925876B2

(12) United States Patent
Kogure

(10) Patent No.: US 11,925,876 B2
(45) Date of Patent: Mar. 12, 2024

(54) MAGNET-TYPE PLATE TOY

(71) Applicant: People Co., Ltd., Tokyo (JP)

(72) Inventor: Masako Kogure, Tokyo (JP)

( * ) Notice: Subject to any disclaimer, the term of this patent is extended or adjusted under 35 U.S.C. 154(b) by 266 days.

(21) Appl. No.: 17/442,623

(22) PCT Filed: May 9, 2019

(86) PCT No.: PCT/JP2019/018618

§ 371 (c)(1),
(2) Date: Sep. 24, 2021

(87) PCT Pub. No.: WO2020/194764

PCT Pub. Date: Oct. 1, 2020

(65) Prior Publication Data

US 2022/0168661 A1 Jun. 2, 2022

(30) Foreign Application Priority Data

Mar. 28, 2019 (JP) ..... 2019-062914

(51) Int. Cl.
*A63H 33/26* (2006.01)
*A63H 33/04* (2006.01)
*A63H 33/10* (2006.01)

(52) U.S. Cl.
CPC ..... *A63H 33/046* (2013.01); *A63H 33/042* (2013.01); *A63H 33/10* (2013.01); *A63H 33/26* (2013.01)

(58) Field of Classification Search
CPC ..... A63H 33/26
See application file for complete search history.

(56) References Cited

U.S. PATENT DOCUMENTS 5,506,459 A * 4/1996 Ritts ..... F16C 39/063 446/256
9,302,195 B2 * 4/2016 Paul ..... A63H 1/24
2011/0009028 A1 * 1/2011 Gurdin ..... A63H 33/26 446/132

FOREIGN PATENT DOCUMENTS

| | | |
|---|---|---|
| CN | 207412743 | 5/2018 |
| CN | 207507018 | 6/2018 |
| DE | 102006003395 | 7/2007 |
| GB | 2481327 | 12/2011 |

(Continued)

OTHER PUBLICATIONS

Extended Search Report in corresponding European Application No. 19921178.0, dated Nov. 4, 2022.

(Continued)

*Primary Examiner* — John A Ricci
(74) *Attorney, Agent, or Firm* — SOEI PATENT & LAW FIRM

(57) ABSTRACT

A magnetic plate toy includes a first plate, a second plate, and a connector. The first plate and the second plate are disposed to oppose each other. The connector extends in an opposing direction of the first plate and the second plate and connects the first plate and the second plate to each other. The first plate includes a first plate member and a plurality of first magnets provided inside the first plate member. The second plate includes a second plate member and a plurality of second magnets provided inside the second plate member to correspond to the plurality of first magnets. The second plate is connected to the connector to be rotatable around the opposing direction as a rotation axis direction.

20 Claims, 7 Drawing Sheets

(56) References Cited

FOREIGN PATENT DOCUMENTS

| | | |
|---|---|---|
| JP | 2006-304950 | 11/2006 |
| JP | 3161698 | 8/2010 |
| JP | 2016-097252 | 5/2016 |
| JP | 2019-033949 | 3/2019 |
| KR | 101664790 | 10/2016 |
| WO | 2006/098530 | 9/2006 |
| WO | 2006/129903 | 12/2006 |

OTHER PUBLICATIONS

International Preliminary Report on Patentability with Written Opinion dated Oct. 7, 2021 for PCT/JP2019/018618.
International Search Report dated Jul. 30, 2019 for PCT/JP2019/018618.

* cited by examiner

MAGNET-TYPE PLATE TOY

CROSS-REFERENCE TO RELATED APPLICATIONS

This application is a 35 U.S.C. § 371 national phase application of PCT Application No. PCT/JP2019/018618, filed on May 9, 2019, which claims priority to Japanese Patent Application No. P2019-062914, filed on Mar. 28, 2019.

TECHNICAL FIELD

An aspect of the present invention relates to a magnetic plate toy.

BACKGROUND ART

Conventionally, a magnetic plate toy which is magnetically connected to a connection object is known as an educational toy (for example, see Patent Literature 1). The magnetic plate toy described in Patent Literature 1 includes polygonal plate members. A magnet is provided inside the plate member along a side portion of the plate member. The plate member is magnetically connected to another magnetic plate toy by using a magnetic force of the magnet. According to such a magnetic plate toy, it is intended to raise children's creativity and imagination through play.

CITATION LIST

Patent Literature

Patent Literature 1: Japanese Utility Model Registration No. 3161698

SUMMARY OF INVENTION

Technical Problem

In the above-described magnetic plate toy, the assembly of the plate members by connection is likely to limit the way of playing, however, a variety of ways of playing are required so that children will not get bored.

Therefore, an aspect of the present invention provides a magnetic plate toy that enables a variety of ways of playing.

Solution to Problem

A magnetic plate toy according to an aspect of the present invention includes a first plate, a second plate, and a connector. The first plate and the second plate are disposed to oppose each other. The connector extends in an opposing direction of the first plate and the second plate and connects the first plate and the second plate to each other. The first plate includes a first plate member and a plurality of first magnets provided inside the first plate member. The second plate includes a second plate member and a plurality of second magnets provided inside the second plate member to correspond to the plurality of first magnets. The second plate is connected to the connector to be rotatable around the opposing direction as a rotation axis direction.

In the magnetic plate toy, the first plate and the second plate are connected to each other by the connector. The second plate is connected to the connector to be rotatable around the opposing direction of the first plate and the second plate as a rotation axis direction. Thus, the second plate can be relatively rotated with respect to the connector and the first plate connected to the connector. Accordingly, a variety of ways of playing is enabled.

In the magnetic plate toy, the first plate and the second plate may be separated from each other in the opposing direction. In this case, a magnetic force applied between the first plate and the second plate becomes weaker than a case in which the first plate and the second plate are not separated from each other. Accordingly, the second plate can be easily rotated even with a weak force.

In the magnetic plate toy, the connector may include a shaft member extending in the opposing direction and a protrusion provided on an outer peripheral surface of the shaft member. The second plate member may be provided with a recess in which the shaft member is disposed. An inner peripheral surface of the recess may be provided with a groove which extends in a circumferential direction of the recess and in which the protrusion is disposed. An inscribed circle of the recess may be larger than a circumscribed circle of the shaft member when viewed from the opposing direction. In this case, the second plate can be rotatably connected to the connector.

In the magnetic plate toy, the inscribed circle of the recess may be smaller than the circumscribed circle of the connector when viewed from the opposing direction. In this case, since the protrusion of the connector is caught in the groove, the movement of the connector in the opposing direction can be limited.

In the magnetic plate toy, each of the outer peripheral surface of the shaft member and the inner peripheral surface of the recess may have a circular shape when viewed from the opposing direction. In this case, the shaft member can be smoothly rotated inside the recess.

In the magnetic plate toy, the second plate member may include an inner member opposing the first plate in the opposing direction and an outer member facing away from the inner member in the opposing direction. The recess may include a through-hole penetrating each of the inner member and the outer member. The groove may be provided between the inner member and the outer member. In this case, since the groove is provided between the inner member and the outer member, the protrusion can be easily disposed in the groove, for example, in such a manner that the inner member and the outer member are combined while the connector is disposed in the inner member or the outer member.

In the magnetic plate toy, the inner member may include a reinforcement portion reinforcing a peripheral edge of the through-hole. In this case, the damage of the inner member can be suppressed.

Advantageous Effects of Invention

According to an aspect of the present invention, it is possible to provide a magnetic plate toy that enables a variety of ways of playing.

DESCRIPTION OF EMBODIMENTS

Figure 1:
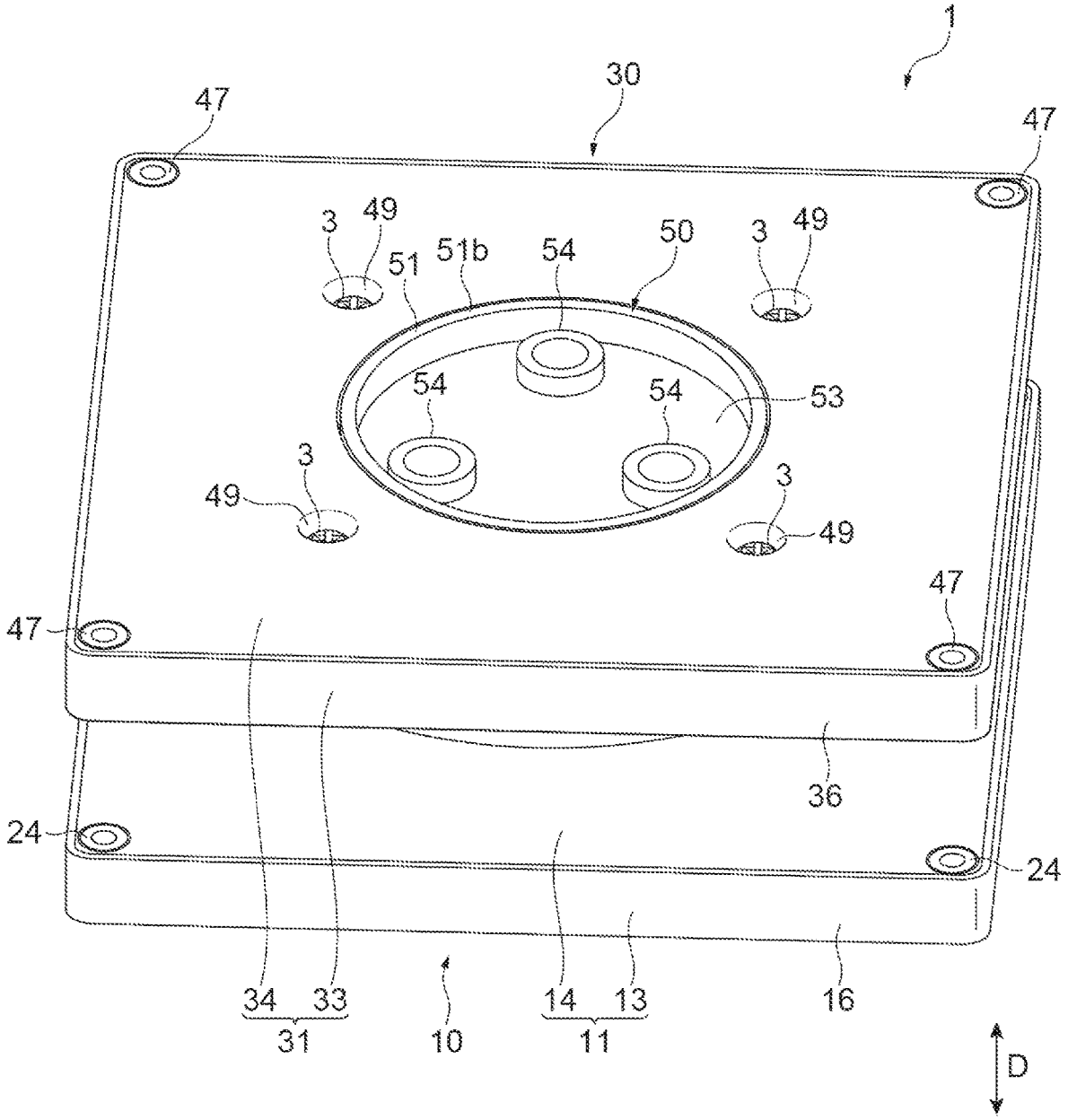
FIG. 1 is a perspective view illustrating a magnetic plate toy according to an embodiment.

Hereinafter, preferred embodiments of the present invention will be described in detail with reference to the accompanying drawings. It should be noted that the same or equivalent components will be denoted by the same reference numerals and the redundant description will be omitted in the description below.

Figure 2:
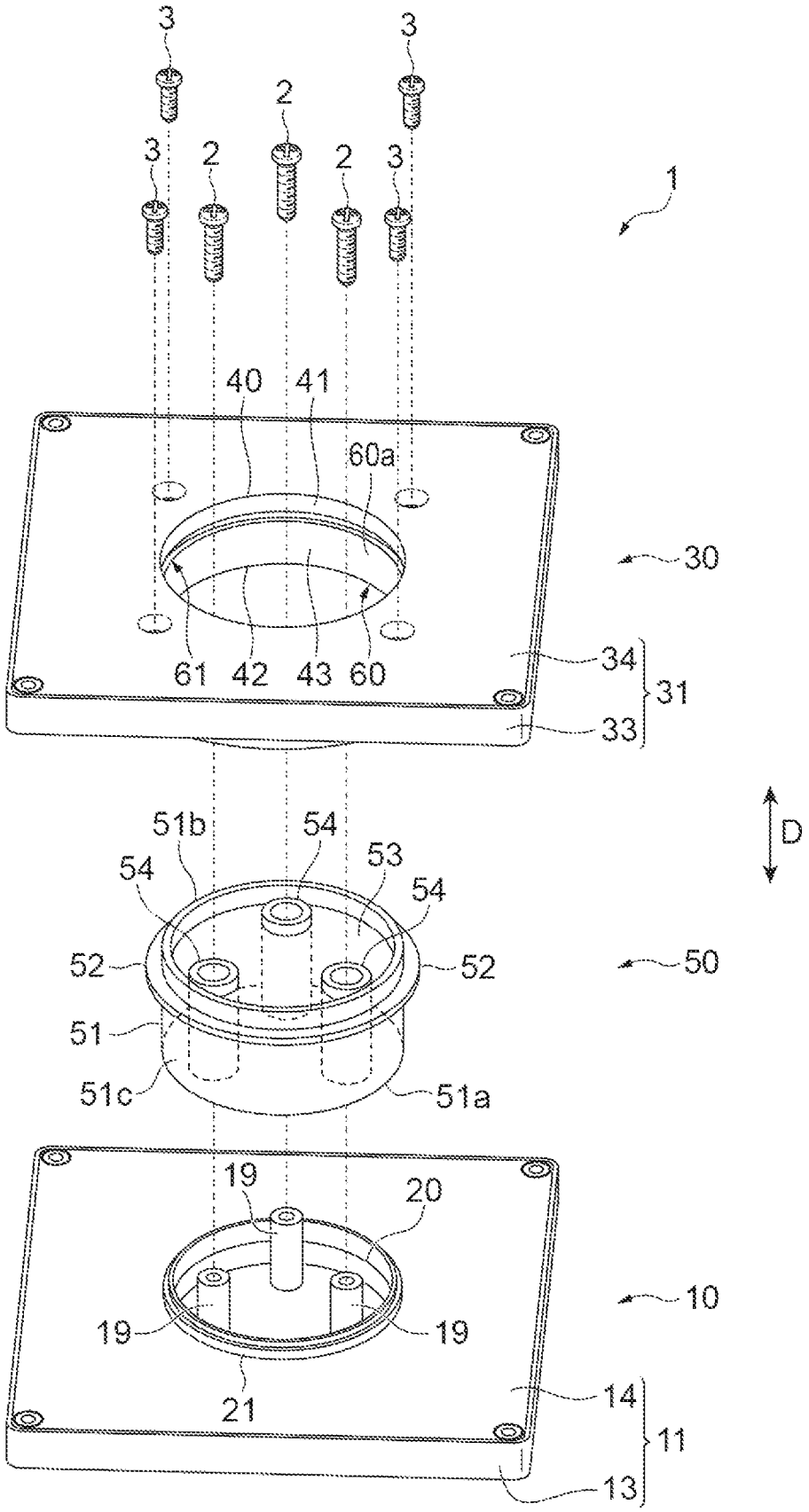
FIG. 2 is an exploded perspective view illustrating the magnetic plate toy of FIG. 1.
Figure 3:
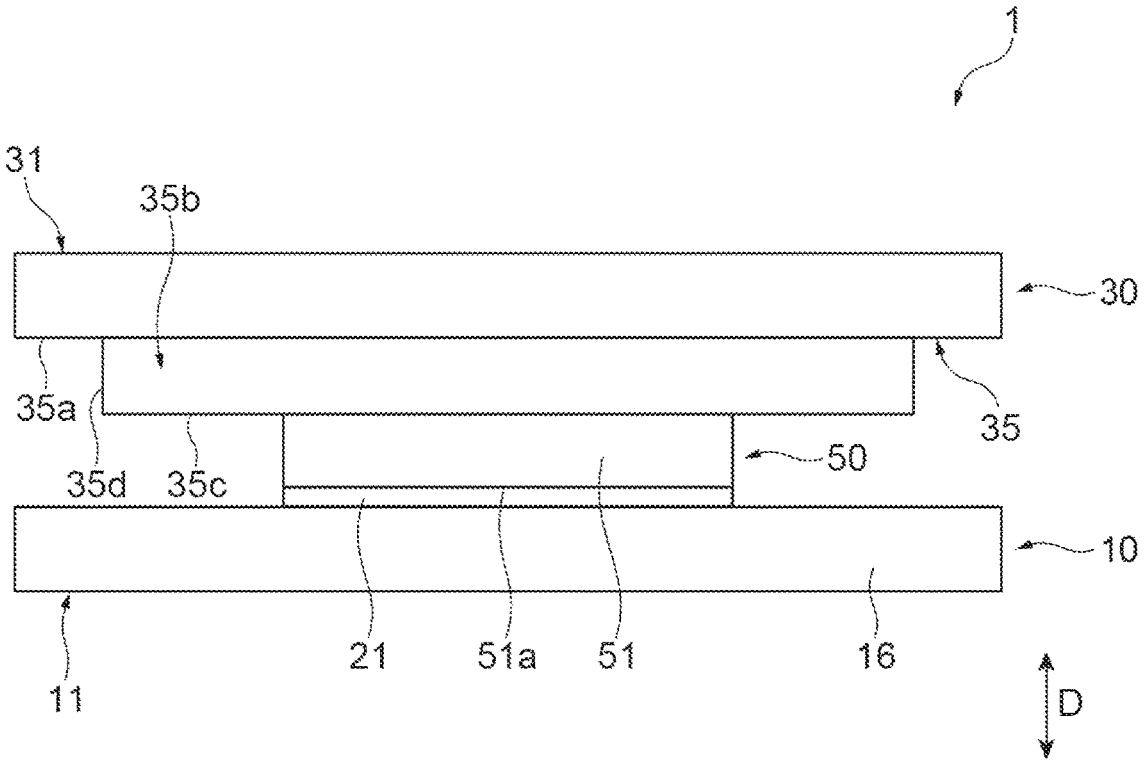
FIG. 3 is a side view illustrating the magnetic plate toy of FIG. 1.

FIG. 1 is a perspective view illustrating a magnetic plate toy according to an embodiment. FIG. 2 is an exploded perspective view illustrating the magnetic plate toy of FIG. 1. FIG. 3 is a side view illustrating the magnetic plate toy 1 of FIG. 1. The magnetic plate toy 1 illustrated in FIGS. 1 to 3 is an educational toy for cultivating children's creativity and imagination through play. The magnetic plate toy 1 includes a first plate 10, a second plate 30, and a connector 50. Since a flange 52 of the connector 50 cannot pass through a through-hole 42 of the second plate 30 as will be described later, the connector 50 and the second plate 30 can be separated precisely as illustrated in FIG. 2 by disassembling the second plate 30.

The first plate 10 and the second plate 30 are disposed to oppose each other. An opposing direction D of the first plate 10 and the second plate 30 matches the thickness direction of the first plate 10 and the second plate 30. The first plate 10 and the second plate 30 are separated from each other in the opposing direction D. The separation distance of the first plate 10 and the second plate 30 is, for example, 13 mm. The first plate 10 is fixed to the connector 50. The second plate 30 is connected to the connector 50 to be rotatable around the opposing direction D as a rotation axis direction.

The connector 50 extends in the opposing direction D and connects the first plate 10 and the second plate 30 to each other. The connector 50 includes a shaft member 51, a flange 52 (protrusion), a closing member 53, and three fitting portions 54. The shaft member 51 has a cylindrical shape and extends in the opposing direction D. That is, the axial direction of the shaft member 51 matches the opposing direction D. The shaft member 51 includes an end portion 51*a* which is located on the side of the first plate 10 and an end portion 51*b* which is located on the side of the second plate 30. An outer peripheral surface 51*c* of the shaft member 51 has a circular shape when viewed from the opposing direction D. The inner diameter of the shaft member 51 is, for example, 32 mm and the outer diameter thereof is, for example, 34 mm. The length of the shaft member 51 in the opposing direction D is, for example, 13 mm.

The flange 52 is a protrusion which is provided on the outer peripheral surface 51*c* of the shaft member 51. The flange 52 is a flange-shaped member that protrudes radially outward from the outer peripheral surface 51*c*. The radial length of the flange 52 (that is, a protrusion height in which the flange 52 protrudes radially from the outer peripheral surface 51*c*) is, for example, 2 mm. The thickness of the flange 52 (the length in the opposing direction D) is, for example, 1.2 mm. The flange 52 is provided over the entire circumference of the outer peripheral surface 51*c* and has an annular shape when viewed from the opposing direction D. The flange 52 is provided in the vicinity of the end portion 51*b*. The closing member 53 is a disk-shaped member that is orthogonal to the opposing direction D and closes the inside of the shaft member 51. The outer edge of the closing member 53 is connected to the inner peripheral surface of the shaft member 51. The closing member 53 is provided in the vicinity of the end portion 51*b*.

The fitting portion 54 is a cylindrical member that is fitted to a fitting portion 19 of the first plate 10 to be described later. The fitting portion 54 is provided in the closing member 53 and extends in the opposing direction D. The fitting portion 54 is provided in the closing member 53 to penetrate the closing member 53 in the opposing direction D.

The connector 50 is made of plastic such as ABS resin (acrylonitrile-butadiene-styrene copolymer). The connector 50 is formed by, for example, injection-molding.

Figure 4:
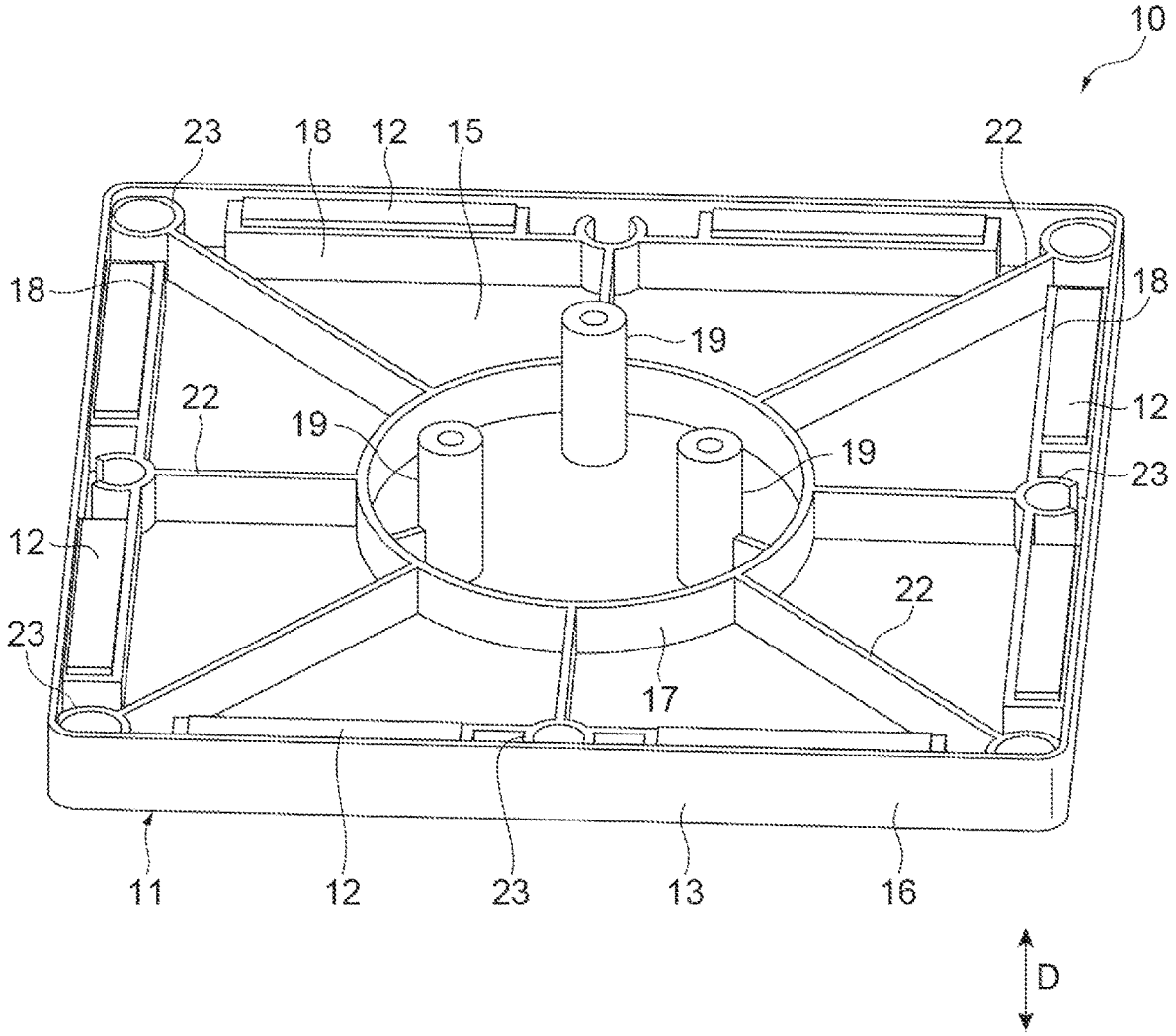
FIG. 4 is a perspective view illustrating a first plate of FIG. 1.

FIG. 4 is a perspective view illustrating the first plate of FIG. 1. In FIG. 4, a lid member 14 to be described later is omitted. As illustrated in FIGS. 1 to 4, the first plate 10 includes a first plate member 11 and a plurality of first magnets 12 provided inside the first plate member 11. The first plate member 11 has, for example, a polygonal shape such as a triangular shape or a rectangular shape when viewed from the opposing direction D. In this embodiment, the first plate member 11 has a square shape having a side of, for example, 75 mm when viewed from the opposing direction D.

The first plate member 11 is a hollow member. The first plate member 11 includes a bottom member 13 and the lid member 14 that face away from each other in the opposing direction D. The first plate member 11 is disposed so that the lid member 14 opposes the second plate 30 in the opposing direction D. That is, the bottom member 13 is an outer member that is disposed on the outside of the magnetic plate toy 1 and the lid member 14 is an inner member that is disposed on the inside of the magnetic plate toy 1.

As illustrated in FIG. 4, the bottom member 13 is a box-shaped member that is open at one surface. The bottom member 13 includes a square bottom wall 15, four rectangular outer walls 16, a cylindrical inner wall 17, eight accommodation walls 18, and three fitting portions 19. The bottom wall 15 faces away from the lid member 14 in the opposing direction D.

As illustrated in FIG. 2, a circular through-hole 20 is provided at the center of the lid member 14. A connection protrusion 21 which is connected to the end portion 51*a* of the shaft member 51 is formed on the upper surface of the lid member 14. The connection protrusion 21 is formed on the peripheral edge of the through-hole 20. The connection protrusion 21 overlaps the end portion 51*a* when viewed from the opposing direction D and has an annular shape. The protrusion height of the connection protrusion 21 is, for example, 2 mm.

The outer wall 16 is provided on the outer edge of the bottom wall 15 and extends in the opposing direction D so that the outer edge of the bottom wall 15 is connected to the outer edge of the lid member 14. The inner wall 17 is provided at the center of the bottom wall 15 and extends in the opposing direction D so that the center of the bottom wall 15 is connected to the peripheral edge of the through-hole 20. An accommodation wall 18 is provided on the outer edge portion of the bottom wall 15 and extends in the opposing direction D so that the outer edge portion of the bottom wall 15 is connected to the outer edge portion of the lid member 14. The length of the outer wall 16 in the opposing direction D is, for example, 6.4 mm and the length of each of the inner wall 17 and the accommodation wall 18 in the opposing direction D is, for example, 4.0 mm.

The accommodation wall 18 constitutes a first magnet accommodation portion together with the bottom wall 15, the outer wall 16, and the lid member 14. The first magnet accommodation portion has an internal space corresponding to the size of the first magnet 12 and the first magnet 12 is accommodated and held in this internal space. The first magnet 12 may be fixed to the inside of the first plate member 11 by, for example, adhering or the like instead of the first magnet accommodation portion.

As illustrated in FIGS. 2 and 4, the fitting portion 19 is a cylindrical member that is fitted to the fitting portion 54 of the connector 50. The fitting portion 19 is provided on the bottom wall 15 to correspond to the fitting portion 54. The fitting portion 19 is provided at the center of the bottom wall 15 exposed by the through-hole 20. The fitting portion 19 extends from the bottom wall 15 toward the connector 50 in the opposing direction D. The top portion of the fitting portion 19 passes through the through-hole 20 and is located outside the lid member 14. The fitting portion 19 is formed so that the outer diameter matches the inner diameter of the fitting portion 54. In a state in which the top portion of the fitting portion 19 is fitted into the fitting portion 54, the fitting portion 19 and the fitting portion 54 are connected to each other by a bolt 2 inserted from the side of the fitting portion 54.

A plurality of ribs 22 are provided inside the bottom member 13. The rib 22 is provided on the bottom wall 15 and extends in the opposing direction D. The top portion of the rib 22 is joined to the lid member 14 by ultrasonic welding or the like. According to the rib 22, the strength of the first plate member 11 is improved.

The first plate member 11 is formed in such a manner that the opening of the bottom member 13 is covered with the lid member 14. The bottom member 13 and the lid member 14 are assembled in such a manner that eight cylindrical fitting portions 23 provided on the edge portion of the bottom member 13 are respectively mutually fitted to eight cylindrical fitting portions (not illustrated) provided on the edge portion of the lid member 14. The fitting portions 23 provided at four corners of the bottom wall 15 are connected to the corresponding fitting portions (not illustrated) of the lid member 14 by a metal eyelet 24 (see FIG. 1).

The first plate member 11 is made of plastic such as ABS resin (acrylonitrile-butadiene-styrene copolymer). The first plate member 11 is formed by, for example, injection-molding.

The first magnet 12 is, for example, a ferrite magnet. The first magnet 12 has, for example, a rectangular parallelepiped shape, and its approximate external dimensions are, for example, 20 mm×5 mm×3 mm. The first magnet 12 is provided along the side (outer wall 16) of the first plate member 11 in the edge portion of the first plate member 11. The first magnet 12 is accommodated in the first magnet accommodation portion. The edge portion of the first plate member 11 includes at least the first magnet accommodation portion. The first magnet 12 is provided inside the outer wall 16 to be adjacent to the outer wall 16. Two first magnets 12 are provided side by side along each outer wall 16.

The first magnet 12 includes an N pole portion which is disposed on one side in the opposing direction D and an S pole portion which is disposed on the other side in the opposing direction D. The two first magnets 12 arranged side by side along the same outer wall 16 are arranged so that the positions of the N pole portion and the S pole portion in the opposing direction D are opposite to each other. In the first plate 10, an even number of the first magnets 12 can be arranged side by side along the same outer wall 16. The first magnets 12 are arranged so that the N pole portion and the S pole portion are point-symmetric with respect to the center of gravity of the outer wall 16. Here, since the outer wall 16 has a rectangular shape, the center of gravity of the outer wall 16 coincides with the intersection of the diagonal lengths of the outer wall 16.

Figure 5:
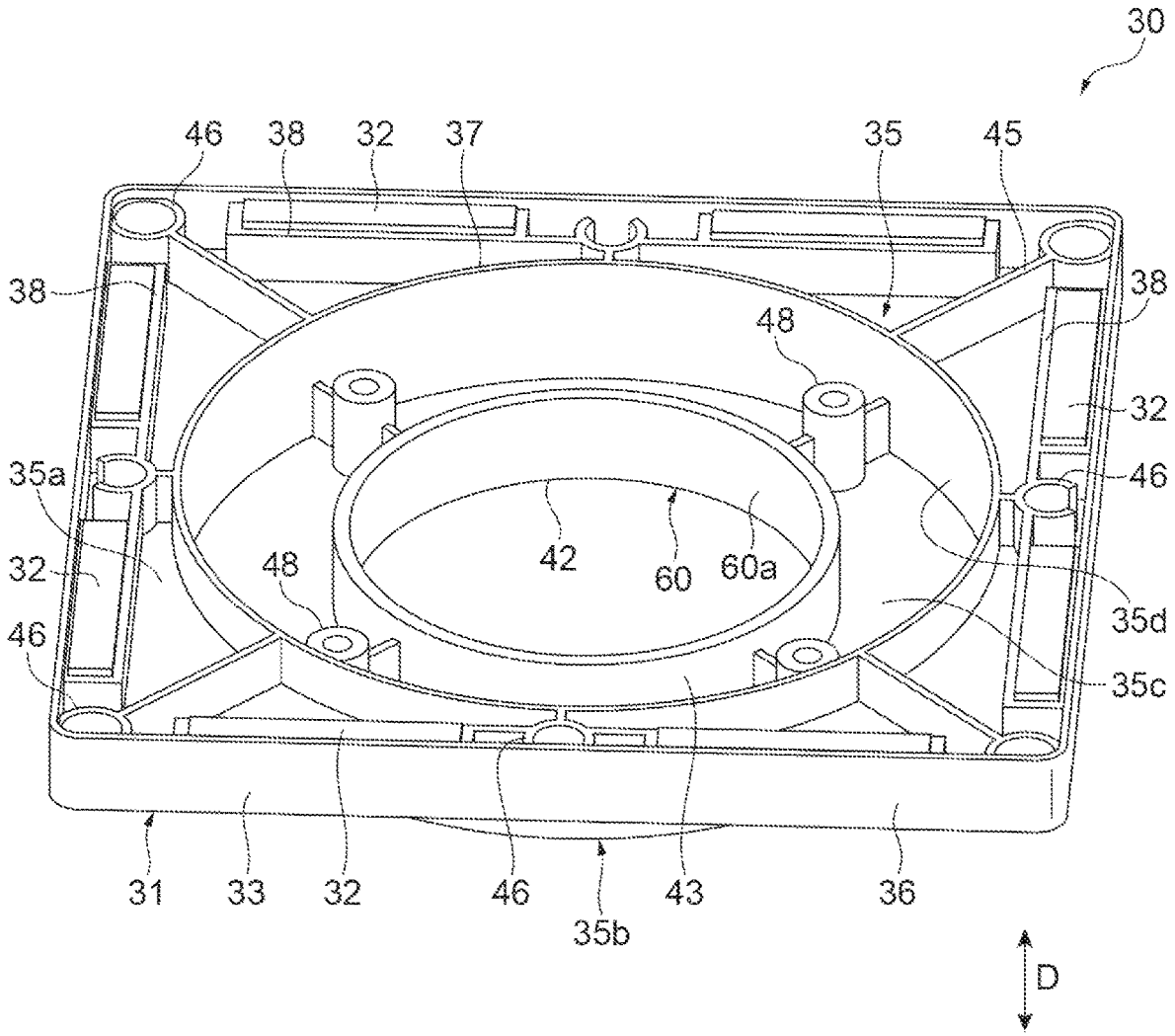
FIG. 5 is a perspective view illustrating a second plate of FIG. 1.
Figure 6:
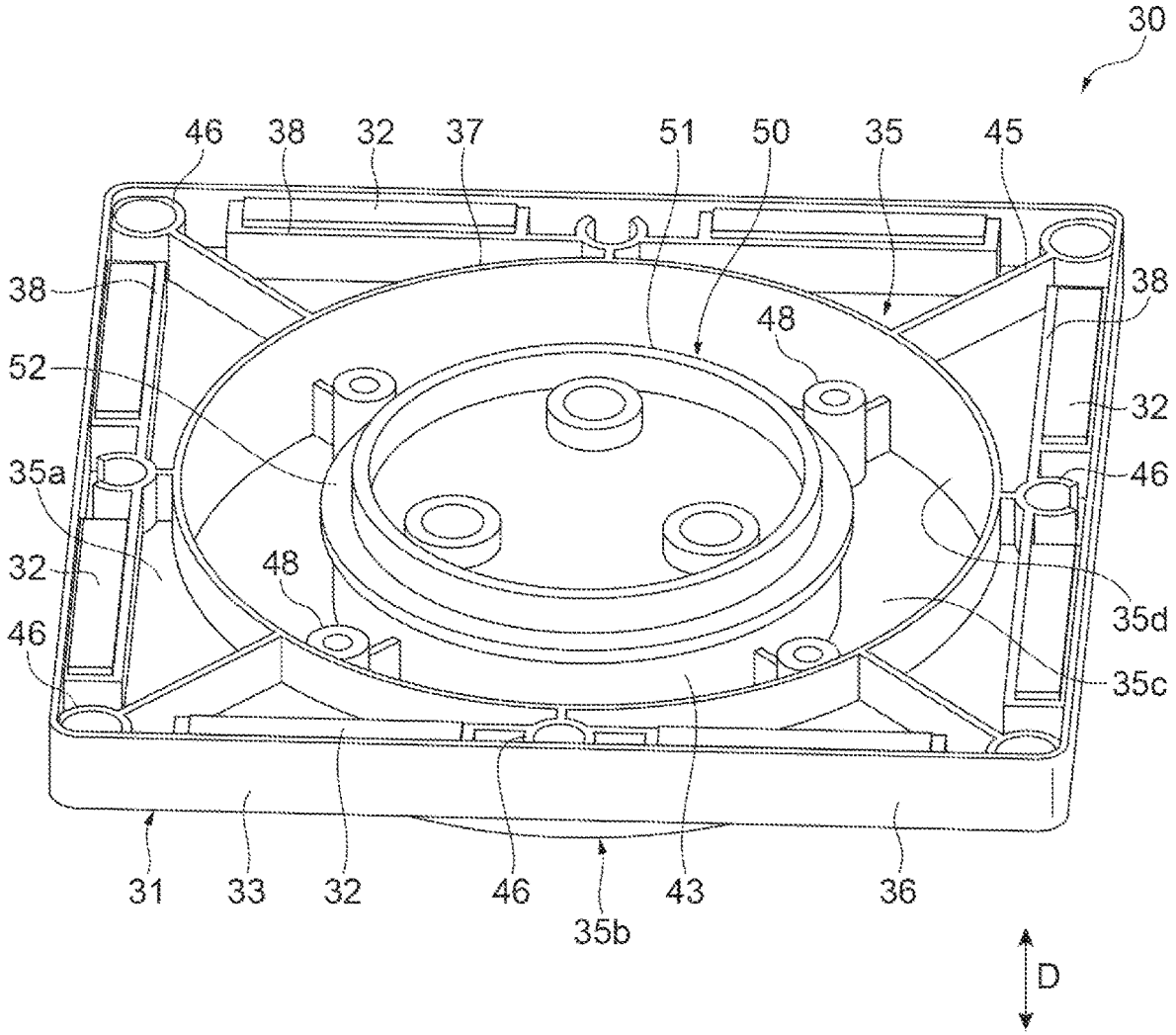
FIG. 6 is a perspective view illustrating the second plate and a connector of FIG. 1.

FIG. 5 is a perspective view illustrating the second plate of FIG. 1. FIG. 6 is a perspective view illustrating the second plate and the connector of FIG. 1. In FIGS. 5 and 6, a lid member 34 to be described later is omitted. As illustrated in FIGS. 1 to 3 and FIGS. 5 and 6, the second plate 30 includes a second plate member 31 and a plurality of second magnets 32 which are provided inside the second plate member 31. The second plate member 31 has, for example, a polygonal shape such as a triangular shape or a rectangular shape when viewed from the opposing direction D. In this embodiment, the second plate member 31 has a square shape having a side of, for example, 75 mm when viewed from the opposing direction D similarly to the first plate member 11.

The second plate member 31 is a hollow member. The second plate member 31 includes a bottom member 33 (inner member) and a lid member 34 (outer member) facing away from each other in the opposing direction D. The second plate member 31 is disposed so that the bottom member 33 opposes the first plate 10 in the opposing direction D. That is, the bottom member 33 is the inner member disposed inside the magnetic plate toy 1 and the lid member 34 is the outer member disposed outside the magnetic plate toy 1.

As illustrated in FIG. 5, the bottom member 33 is a box-shaped member that is open at one surface. The bottom member 33 includes a bottom wall 35, four rectangular outer walls 36, a cylindrical inner wall 37, and eight accommodation walls 38. The bottom wall 35 faces away from the lid member 34 in the opposing direction D.

As illustrated in FIG. 2, a circular through-hole 40 in which the shaft member 51 of the connector 50 is disposed is provided at the center of the lid member 34. The through-hole 40 is formed in a size in which the shaft member 51 can be disposed. That is, the inner diameter of the through-hole 40 is longer than the outer diameter of the shaft member 51. The inscribed circle of the through-hole 40 is larger than the circumscribed circle of the shaft member 51 when viewed from the opposing direction D. The through-hole 40 is formed in a size in which the flange 52 cannot pass. That is, the inner diameter of the through-hole 40 is shorter than the outer diameter of the flange 52. The inscribed circle of the through-hole 40 is smaller than the circumscribed circle of the connector 50 when viewed from the opposing direction D. The inner diameter of the through-hole 40 is, for example, 35 mm.

The lid member 34 includes a holding protrusion 41 which holds the flange 52. The holding protrusion 41 is provided on the peripheral edge of the through-hole 40 and protrudes toward the inside of the second plate member 31 in the opposing direction D. The holding protrusion 41 opposes a holding protrusion 43 to be described later in the opposing direction D with the flange 52 interposed therebetween. The holding protrusion 41 has an annular shape when viewed from the opposing direction D. The protrusion height of the holding protrusion 41 is, for example, 3 mm. The holding protrusion 41 also functions as a reinforcement portion for reinforcing the peripheral edge of the through-hole 40.

As illustrated in FIG. 5, the bottom wall 35 has a square shape when viewed from the opposing direction D. Also as illustrated in FIG. 3, the bottom wall 35 includes a first bottom portion 35*a* and a protruding portion 35*b* which protrudes from the first bottom portion 35*a* toward the first plate 10. The protruding portion 35*b* is disposed at the center of the bottom wall 35 when viewed from the opposing direction D. The first bottom portion 35*a* is disposed around the protruding portion 35*b* and includes the entire outer edge of the bottom wall 35. The protruding portion 35*b* includes a second bottom portion 35*c* and a connecting portion 35*d*. The second bottom portion 35*c* is disposed in parallel to the first bottom portion 35*a*. The second bottom portion 35*c* has, for example, a circular shape having a diameter of 60 mm when viewed from the opposing direction D. The connecting portion 35*d* has a cylindrical shape extending in the opposing direction D and connects the first bottom portion 35*a* and the second bottom portion 35*c* to each other. The length of the connecting portion 35*d* in the opposing direction D is, for example, 6 mm. The connecting portion 35*d* is integrally formed with the inner wall 37 to be continuous to the inner wall 37. The connecting portion 35*d* and the inner wall 37 overlap each other when viewed from the opposing direction D.

As illustrated in FIGS. 2 and 5, the circular through-hole 42 in which the shaft member 51 of the connector 50 is disposed is provided at the center of the second bottom portion 35*c*. The through-hole 42 is formed in a size in which the shaft member 51 of the connector 50 can be disposed. That is, the inner diameter of the through-hole 42 is longer than the outer diameter of the shaft member 51. The inscribed circle of the through-hole 42 is larger than the circumscribed circle of the shaft member 51 when viewed from the opposing direction D. The through-hole 42 is formed in a size in which the flange 52 cannot pass. That is, the inner diameter of the through-hole 42 is shorter than the outer diameter of the flange 52. The inscribed circle of the through-hole 42 is smaller than the circumscribed circle of the connector 50 when viewed from the opposing direction D. The through-hole 42 has, for example, the same shape as the through-hole 40 and overlaps the through-hole 40 when viewed from the opposing direction D. The inner diameter of the through-hole 42 is, for example, 35 mm.

The second bottom portion 35*c* includes the holding protrusion 43 which holds the flange 52 together with the holding protrusion 41. The holding protrusion 43 is provided on the peripheral edge of the through-hole 42 and protrudes toward the inside of the second plate member 31 in the opposing direction D. The holding protrusion 43 opposes the holding protrusion 41 in the opposing direction D with the flange 52 interposed therebetween. The holding protrusion 43 has an annular shape or a cylindrical shape when viewed from the opposing direction D. The protrusion height of the holding protrusion 43 is, for example, 7 mm. The holding protrusion 43 functions as a reinforcement portion reinforcing the peripheral edge of the through-hole 42. Since the protruding portion 35*b* is provided in the bottom member 33, the protrusion height of the holding protrusion 43 can be increased. Accordingly, the reinforcement effect can be increased.

The through-holes 40 and 42 and the holding protrusions 41 and 43 constitute a recess 60 in which the shaft member 51 is disposed (inserted). In this embodiment, the recess 60 is provided in the second plate 30 to penetrate the entire second plate 30 in the opposing direction D. A gap between the holding protrusion 41 and the holding protrusion 43 constitutes a groove 61 in which the flange 52 is disposed. The groove 61 is provided between the holding protrusion 41 and the holding protrusion 43 and is formed in a size in which the flange 52 can be disposed. That is, the width (the length in the opposing direction D) of the groove 61 is greater than the thickness (the length in the opposing direction D) of the flange 52. The width of the groove 61 is, for example, 2 mm. It can be said that the groove 61 is provided on an inner peripheral surface 60*a* of the recess 60 and extends in the circumferential direction of the recess 60. The groove 61 limits the movement of the flange 52 in the opposing direction D. That is, the movement of the connector 50 in the opposing direction D is limited by the groove 61. The movement range of the connector 50 in the opposing direction D is set by the width of the groove 61.

An outer wall 36 is provided on the outer edge of the first bottom portion 35*a* and extends in the opposing direction D so as to connect the outer edge of the first bottom portion 35*a* and the outer edge of the lid member 34. The inner wall 37 is provided on the inner edge of the first bottom portion 35*a* and extends in the opposing direction D so as to connect the inner edge of the first bottom portion 35*a* and the lid member 34. The accommodation wall 38 is provided on the outer edge portion of the first bottom portion 35*a* and extends in the opposing direction D so that the outer edge portion of the first bottom portion 35*a* is connected to the outer edge portion of the lid member 34. The length of the outer wall 36 in the opposing direction D is, for example, 6.4 mm and the length of the inner wall 37 and the accommodation wall 38 in the opposing direction D is, for example, 4.0 mm.

The accommodation wall 38 constitutes a second magnet accommodation portion together with the first bottom portion 35*a*, the outer wall 36, and the lid member 34. The second magnet accommodation portion has an internal space corresponding to the size of the second magnet 32 and accommodates and holds the second magnet 32 in the internal space. The second magnet 32 may be fixed into the second plate member 31 by, for example, adhering or the like instead of the second magnet accommodation portion.

A plurality of ribs 45 are provided inside the bottom member 33. The rib 45 is provided in the first bottom portion 35*a* and extends in the opposing direction D. The top portion of the rib 45 is joined to the lid member 34 by ultrasonic welding or the like. According to the rib 45, the strength of the second plate member 31 is improved.

The second plate member 31 is formed in such a manner that the opening of the bottom member 33 is covered with the lid member 34. The bottom member 33 and the lid member 34 are assembled in such a manner that eight cylindrical fitting portions 46 provided on the edge portion of the first bottom portion 35*a* are respectively mutually fitted to eight cylindrical fitting portions (not illustrated) provided on the edge portion of the lid member 34. The fitting portions 46 provided at four corners of the first bottom portion 35*a* are connected to the corresponding fitting portions of the lid member 34 by a metal eyelet 47 (see FIG. 1).

The bottom member 33 and the lid member 34 are assembled also in such a manner that four cylindrical fitting portions 48 provided in the second bottom portion 35*c* are respectively mutually fitted to four cylindrical fitting portions 49 (see FIG. 1) provided in the lid member 34. The fitting portion 48 extends from the second bottom portion 35*c* toward the lid member 34 in the opposing direction D. The fitting portion 48 is formed so that the outer diameter matches the inner diameter of the fitting portion 49. In a state in which the top portion of the fitting portion 48 is fitted into the fitting portion 49, the fitting portion 48 and the fitting portion 49 are connected to each other by a bolt 3 inserted from the side of the fitting portion 49.

Since the flange 52 cannot pass through the through-hole 42 as described above, first, as illustrated in FIG. 6, the connector 50 is disposed in the bottom member 33 to which the lid member 34 is not attached in order to assemble the connector 50 and the second plate 30. Subsequently, the second plate 30 is assembled by attaching the lid member 34 to the bottom member 33 using the metal eyelet 47 and the bolt 3. Accordingly, the connector 50 and the second plate 30 can be integrally assembled.

The second plate member 31 is made of plastic such as ABS resin (acrylonitrile-butadiene-styrene copolymer). Since the second plate member 31 is made of plastic, the second plate member can be manufactured by, for example, injection-molding.

Similarly to the first magnet 12, the second magnet 32 is, for example, a ferrite magnet. The second magnet 32 is provided to correspond to the first magnet 12. Specifically, the shape and the number of the second magnet 32 are the same as those of the first magnet 12. Each second magnet 32 is disposed to overlap each first magnet 12 when viewed from the opposing direction D. The second magnet 32 is provided along the side (outer wall 36) of the second plate member 31 inside the edge portion of the second plate member 31. The second magnet 32 is accommodated in the second magnet accommodation portion. The edge portion of the second plate member 31 includes at least the second magnet accommodation portion. The second magnet 32 is provided inside the outer wall 36 to be adjacent to the outer wall 36. Two second magnets 32 are provided side by side along each outer wall 36.

The second magnet 32 includes an N pole portion which is disposed on one side in the opposing direction D and an S pole portion which is disposed on the other side in the opposing direction D. The second magnets 32 are arranged similarly to the first magnets 12. That is, two second magnets 32 arranged along the same outer wall 36 are arranged so that the positions of the N pole portion and the S pole portion in the opposing direction D are opposite to each other. In the second plate 30, an even number of the second magnets 32 can be arranged along the same outer wall 36. The second magnets 32 are arranged so that the N pole portion and the S pole portion are point-symmetrical with respect to the center of gravity of the outer wall 36.

In the magnetic plate toy 1 with the above-described configuration, the first plate 10 and the second plate 30 which are disposed to oppose each other are connected by the connector 50. The second plate 30 is connected to the connector 50 to be rotatable around the opposing direction D as the rotation axis direction. Thus, the second plate 30 can be relatively rotated with respect to the connector 50 and the first plate 10 connected to the connector 50. Accordingly, a variety of ways of playing is enabled.

The first plate 10 and the second plate 30 are separated from each other in the opposing direction D. Thus, a magnetic force applied between the first magnet 12 and the second magnet 32 becomes weaker than a case in which the first plate 10 and the second plate 30 are not separated from each other. Accordingly, the second plate 30 can be easily rotated even with a weak force of children.

The first plate 10 and the second plate 30 have a configuration in which the first magnet 12 and the second magnet 32 attract each other most at the positions where the sides of the first plate 10 and the second plate 30 coincide with each other when viewed from the opposing direction D. Thus, for example, when the second plate 30 is moved and rotated by a hand, the second plate 30 attempts to rotate to a position where the sides of the first plate 10 and the second plate 30 coincide with each other when viewed from the opposing direction D regardless of the position where the hand is released from the second plate 30. The magnitude of this application can be set, for example, by the separation distance between the first plate 10 and the second plate 30 (the separation distance between the first magnet 12 and the second magnet 32). Since the first plate 10 and the second plate 30 rotate to predetermined positions even after the hand is released, the child can have imagination.

Further, for example, when the second plate 30 is moved and rotated by a hand, a force is required when passing through the position where the respective sides of the first plate 10 and the second plate 30 coincide with each other when viewed from the opposing direction D and almost no force is required when passing through other positions. Such a click feeling can be set by, for example, the separation distance between the first plate 10 and the second plate 30 (the separation distance between the first magnet 12 and the second magnet 32).

The connector 50 includes the shaft member 51 that extends in the opposing direction D and the flange 52 which is provided on the outer peripheral surface 51*c* of the shaft member 51. The second plate member 31 is provided with the recess 60 in which the shaft member 51 is disposed. The inner peripheral surface 60*a* of the recess 60 is provided with the groove 61 which extends in the circumferential direction of the recess 60 and in which the flange 52 is disposed. The inscribed circle of the recess 60 is larger than the circumscribed circle of the shaft member 51 when viewed from the opposing direction D. Accordingly, the shaft member 51 can be rotatably disposed in the recess 60. Accordingly, the second plate 30 can be rotatably connected to the connector 50.

The inscribed circle of the recess 60 is smaller than the circumscribed circle of the connector 50 when viewed from the opposing direction D. In this embodiment, the circumscribed circle of the connector 50 is defined by the outer edge of the flange 52. Thus, since the flange 52 is caught in the groove 61, the movement of the connector 50 in the opposing direction D can be limited.

The shaft member 51 has a cylindrical shape and the through-holes 40 and 42 have a cylindrical shape. That is, each of the outer peripheral surface 51*c* of the shaft member 51 and the inner peripheral surface 60*a* of the recess 60 has a circular shape when viewed from the opposing direction D. Therefore, the shaft member 51 can be smoothly rotated in the recess 60.

The second plate member 31 includes the bottom member 33 that opposes the first plate 10 in the opposing direction D and the lid member 34 that faces away from the bottom member 33 in the opposing direction D. The recess 60 includes the through-hole 42 of the bottom member 33 and the through-hole 40 of the lid member 34. The groove 61 is provided between the bottom member 33 and the lid member 34. Therefore, the flange 52 can be easily disposed in the groove 61 by assembling the bottom member 33 and the lid member 34, for example, in a state in which the connector 50 is disposed in the bottom member 33.

The bottom member 33 includes the holding protrusion 43 which is the reinforcement portion reinforcing the peripheral edge of the through-hole 40. Accordingly, the damage of the bottom member 33 can be suppressed. The lid member 34 includes the holding protrusion 41 as the reinforcement portion reinforcing the peripheral edge of the through-hole 42. Accordingly, the damage of the lid member 34 can be suppressed.

Since the first magnet 12 and the second magnet 32 are respectively provided on the edge portion of the first plate member 11 and the edge portion of the second plate member 31, other magnetic plate members (not illustrated) can be joined to respective edge portions. Accordingly, a variety of ways of playing can be further enabled.

Although the embodiment of the present invention has been described, the present invention is not limited to the above-described embodiment and may be modified in a range not departing from the spirit described in the claims or may be applied to another case.

Figure 7:
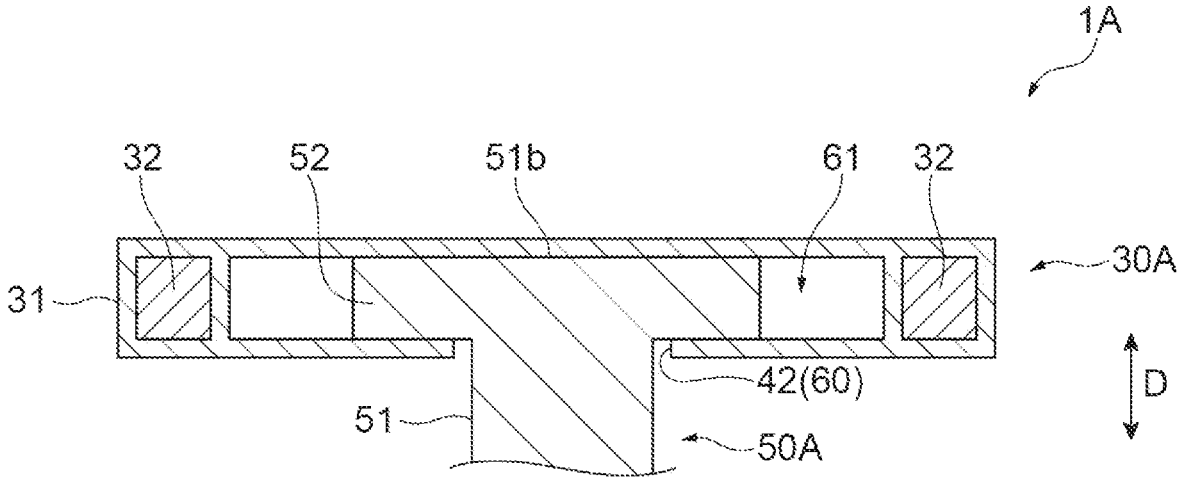
FIG. 7 is a cross-sectional view illustrating a magnetic plate toy according to a modified example.

FIG. 7 is a cross-sectional view illustrating a magnetic plate toy according to a modified example. As illustrated in FIG. 7, in a magnetic plate toy 1A shown in the modified example, the protruding portion 35*b*, the through-hole 40, the holding protrusion 41, and the holding protrusion 43 illustrated in FIGS. 2 and 3 are not provided in a second plate 30A. The recess 60 is formed by the through-hole 42. The recess 60 does not penetrate the entire second plate 30A. The flange 52 is provided at the end portion 51*b* of the shaft member 51.

In the magnetic plate toys 1 and 1A, the first plate 10 is fixed to the connectors 50 and 50A, but the first plate 10 may be connected to the connectors 50 and 50A to be rotatable around the opposing direction D as the rotation axis direction similarly to the second plates 30 and 30A.

In the magnetic plate toys 1 and 1A, the shaft member 51 may have a columnar shape extending in the opposing direction D and the outer peripheral surface 51*c* of the shaft member 51 may have, for example, a polygonal shape when viewed from the opposing direction D. Further, the inner peripheral surface 60*a* of the recess 60 may have, for example, a polygonal shape when viewed from the opposing direction D. Also in such a case, since the inscribed circle of the recess 60 is larger than the circumscribed circle of the shaft member 51 when viewed from the opposing direction D, the second plates 30 and 30A can be rotatably connected to the connectors 50 and 50A.

The magnetic plate toys 1 and 1A may include three or more plates. For example, the magnetic plate toys 1 and 1A may further include a third plate (not illustrated) which opposes the first plate 10 in the opposing direction D with the second plates 30 and 30A interposed therebetween and the connectors 50 and 50A may connect not only the first plate 10 and the second plates 30 and 30A but also the second plates 30 and 30A and the third plate. In this case, the third plate may be rotatably connected to the connectors 50 and 50A.

REFERENCE SIGNS LIST

1, 1A: magnetic plate toy, 10: first plate, 11: first plate member, 12: first magnet, 30, 30A: second plate, 31: second plate member, 32: second magnet, 33: bottom member (inner member), 34: lid member (outer member), 40: through-hole, 41: holding protrusion, 42: through-hole, 43: holding protrusion (reinforcement portion), 50, 50A: connector, 51: shaft member, 51*c*: outer peripheral surface, 52: flange (protrusion), 60: recess, 60*a*: inner peripheral surface, 61: groove, D: opposing direction.

The invention claimed is:

1. A magnetic plate toy comprising:

a first plate and a second plate that oppose each other in an opposing direction; and a connector extending in the opposing direction and connecting the first plate to the second plate, wherein the first plate includes a first plate member and a plurality of first magnets provided inside the first plate member, wherein the second plate includes a second plate member and a plurality of second magnets provided inside the second plate member that correspond to the plurality of first magnets, wherein the second plate is connected to the connector to be rotatable around a rotation axis that is oriented in the opposing direction in order to selectively align the plurality of second magnets with the plurality of first magnets in the opposing direction in response to a rotation of the second plate relative to the first plate, wherein the connector includes a shaft member extending in the opposing direction and a protrusion provided on an outer peripheral surface of the shaft member, wherein the second plate member is provided with a recess in which the shaft member is disposed, wherein an inner peripheral surface of the recess is provided with a groove which extends in a circumferential direction of the recess and in which the protrusion is disposed, and wherein an inscribed circle of the recess is larger than a circumscribed circle of the shaft member when viewed from the opposing direction.

2. The magnetic plate toy according to claim 1, wherein the first plate and the second plate are separated from each other in the opposing direction while the second plate is rotated relative to the first plate.

3. The magnetic plate toy according to claim 1, wherein an inscribed circle of the recess is smaller than a circumscribed circle of the connector when viewed from the opposing direction.

4. The magnetic plate toy according to claim 1, wherein each of an outer peripheral surface of the shaft member and an inner peripheral surface of the recess has a circular shape when viewed from the opposing direction.

5. The magnetic plate toy according to claim 1, wherein the second plate member includes an inner member and an outer member, wherein the inner member is located between the first plate and the outer member in the opposing direction, wherein the recess includes a through-hole penetrating each of the inner member and the outer member, and wherein the groove is provided between the inner member and the outer member.

6. The magnetic plate toy according to claim 5, wherein the inner member includes a reinforcement portion reinforcing a peripheral edge of the through-hole.

7. The magnetic plate toy according to claim 1, wherein the connector penetrates the second plate member in the opposing direction and includes an end portion that is exposed by a through-hole of the second plate member.

8. A magnetic plate toy comprising:

a first plate and a second plate that oppose each other in an opposing direction; and a connector extending in the opposing direction and connecting the first plate to the second plate, wherein the first plate includes a first plate member and a plurality of first magnets provided inside the first plate member, wherein the second plate includes a second plate member and a plurality of second magnets provided inside the second plate member that correspond to the plurality of first magnets, wherein the second plate is connected to the connector to be rotatable around a rotation axis that is oriented in the opposing direction in order to selectively align the plurality of second magnets with the plurality of first magnets in the opposing direction in response to a rotation of the second plate relative to the first plate, wherein the first plate member includes an outer side wall having a length orthogonal to the opposing direction, and wherein an accommodation portion that accommodates at least one of the plurality of first magnets includes an inner wall extending along the length of the outer side wall.

9. A magnetic plate toy comprising:

a first plate and a second plate that oppose each other in an opposing direction; and a connector extending in the opposing direction and connecting the first plate to the second plate, wherein the first plate includes a first plate member and a plurality of first magnets provided inside the first plate member, wherein the second plate includes a second plate member and a plurality of second magnets provided inside the second plate member that correspond to the plurality of first magnets, wherein the second plate is connected to the connector to be rotatable around a rotation axis that is oriented in the opposing direction in order to selectively align the plurality of second magnets with the plurality of first magnets in the opposing direction in response to a rotation of the second plate relative to the first plate, wherein the first plate member includes a plurality of accommodation portions respectively accommodating the plurality of first magnets, wherein the first plate member includes four outer side walls, and wherein the plurality of accommodation portions includes four pairs of accommodation portions respectively arranged along the four outer side walls.

10. A magnetic plate toy comprising:

a first plate and a second plate that oppose each other in an opposing direction; and a connector extending in the opposing direction and connecting the first plate to the second plate, wherein the first plate includes a first plate member and a plurality of first magnets provided inside the first plate member, wherein the second plate includes a second plate member and a plurality of second magnets provided inside the second plate member that correspond to the plurality of first magnets, wherein the second plate is connected to the connector to be rotatable around a rotation axis that is oriented in the opposing direction in order to selectively align the plurality of second magnets with the plurality of first magnets in the opposing direction in response to a rotation of the second plate relative to the first plate, and wherein the first plate member is non-rotatably fixed to the connector.

11. A magnetic plate toy comprising:

a first plate and a second plate that oppose each other in an opposing direction; and a connector extending in the opposing direction and connecting the first plate to the second plate, wherein the first plate includes a first plate member and a plurality of first magnets provided inside the first plate member, wherein the second plate includes a second plate member and a plurality of second magnets provided inside the second plate member that correspond to the plurality of first magnets, wherein the second plate is connected to the connector to be rotatable around a rotation axis that is oriented in the opposing direction in order to selectively align the plurality of second magnets with the plurality of first magnets in the opposing direction in response to a rotation of the second plate relative to the first plate, wherein the first plate member includes a plurality of first fitting portions separated from each other when viewed form the opposing direction, and wherein the connector includes a plurality of second fitting portions separated from each other when viewed form the opposing direction and respectively fitted to the plurality of first fitting portions.

12. A magnetic plate toy comprising:

a first plate and a second plate that oppose each other in an opposing direction; and a connector extending in the opposing direction and connecting the first plate to the second plate, wherein the first plate includes a first plate member and a plurality of first magnets provided inside the first plate member, wherein the second plate includes a second plate member and a plurality of second magnets provided inside the second plate member that correspond to the plurality of first magnets, wherein the second plate is connected to the connector to be rotatable around a rotation axis that is oriented in the opposing direction in order to selectively align the plurality of second magnets with the plurality of first magnets in the opposing direction in response to a rotation of the second plate relative to the first plate, wherein the connector includes a shaft member extending in the opposing direction and a protrusion provided on an outer peripheral surface of the shaft member, and wherein the connector is connected to the second plate by coupling the protrusion to the second plate.

13. The magnetic plate toy according to claim 12, wherein the protrusion has a flange shape extending along a circumferential direction of the shaft member.

14. The magnetic plate toy according to claim 12, wherein the protrusion has an annular shape when viewed from the opposing direction.

15. A magnetic plate toy comprising:

a first plate and a second plate that oppose each other in an opposing direction; and a connector extending in the opposing direction and connecting the first plate to the second plate, wherein the first plate includes a first plate member and a plurality of first magnets provided inside the first plate member, wherein the second plate includes a second plate member and a plurality of second magnets provided inside the second plate member that correspond to the plurality of first magnets, wherein the second plate is connected to the connector to be rotatable around a rotation axis that is oriented in the opposing direction in order to selectively align the plurality of second magnets with the plurality of first magnets in the opposing direction in response to a rotation of the second plate relative to the first plate, wherein the second plate member includes a cylindrical protruding portion that extends toward the first plate in the opposing direction, wherein the second plate member is provided with a recess into which the connector is inserted, and wherein the protruding portion reinforces the recess.

16. A magnetic plate toy comprising:

a first plate and a second plates that oppose each other in an opposing direction; and a connector extending in the opposing direction and connecting the first plate to the second plate, wherein the first plate includes a first plate member and a first magnet provided inside the first plate member, wherein the second plate includes a second plate member and a second magnet provided inside the second plate member, and wherein the second plate is connected to the connector to be rotatable around a rotation axis that is oriented in the opposing direction, wherein the connector includes a shaft member extending in the opposing direction and a protrusion provided on an outer peripheral surface of the shaft member, and wherein the connector is connected to the second plate by coupling the protrusion to the second plate.

17. The magnetic plate toy according to claim 16, wherein the second plate is rotatably connected to the connector in order to align the second magnet with the first magnet in the opposing direction in response to a rotation of the second plate relative to the first plate.

18. A magnetic plate toy comprising:

a first plate including a first plate member housing a first magnet;

a second plate that opposes the first plate in an opposing direction and that includes a second plate member housing a second magnet, wherein the second magnet has an opposite polarity to the first magnet in the opposing direction; and a connector extending in the opposing direction and connecting the first plate to the second plate, wherein the connector includes a shaft member extending in the opposing direction that couples the second plate to the connector through a rotational flange and groove connection in order to selectively align the second magnet with the first magnet in the opposing direction in response to a rotation of the second plate relative to the first plate.

19. The magnetic plate toy according to claim 18, wherein the second plate comprises a cylindrical recess into which the shaft member of the connector is inserted, and wherein the rotational flange and groove connection comprises:

a flange provided on an outer peripheral surface of the shaft member; and a groove provided on an inner peripheral surface of the cylindrical recess.

20. The magnetic plate toy according to claim 19, wherein the second plate member includes an inner member and an outer member, wherein the inner member is located between the first plate and the outer member in the opposing direction, wherein the cylindrical recess includes a through-hole penetrating each of the inner member and the outer member and forming the inner peripheral surface of the cylindrical recess, and wherein the groove is provided between the inner member and the outer member.

* * * * *